United States Patent [19]

Mutter et al.

[11] Patent Number: 4,830,299

[45] Date of Patent: May 16, 1989

[54] TUBE GRIPPING SYSTEM FOR A WINDER CHUCK

[75] Inventors: Heinz Mutter, Winterthur; Ruedi Schneeberger, Turbenthal; Erwin Holbein, Neuhausen, all of Switzerland

[73] Assignee: Maschinenfabrik Rieter AG, Winterthur, Switzerland

[21] Appl. No.: 117,873

[22] Filed: Nov. 9, 1987

[30] Foreign Application Priority Data

Nov. 11, 1986 [CH] Switzerland ..... 04490/86

[51] Int. Cl.[4] ..... B65H 54/54

[52] U.S. Cl. ..... 242/46.4

[58] Field of Search ..... 242/46.4, 46.2, 46.3, 242/46.5, 46.6, 72 R, 72.1, 68.2; 279/2 R, 2 A

[56] References Cited

U.S. PATENT DOCUMENTS

| | | | |
|---|---|---|---|
| 2,941,735 | 6/1960 | Wyeth | 242/46.2 |
| 4,142,690 | 3/1979 | Karle et al. | 242/46.4 |
| 4,232,835 | 11/1980 | Benin | 242/46.4 |

FOREIGN PATENT DOCUMENTS

| | | |
|---|---|---|
| 0217276 | 4/1987 | European Pat. Off. . |
| 788244 | 12/1957 | United Kingdom . |

*Primary Examiner*—Stanley N. Gilreath

*Attorney, Agent, or Firm*—Werner W. Kleeman

[57] ABSTRACT

A chuck for a winding machine has a tube gripping system with rubber or elastomeric springs which generate a bias to press tube gripping elements against the internal surface of a bobbin tube.

16 Claims, 3 Drawing Sheets

TUBE GRIPPING SYSTEM FOR A WINDER CHUCK

BACKGROUND OF THE INVENTION

The present invention broadly relates to a new and improved construction of a tube gripping system for a winder chuck for winding synthetic filament threads or yarns or the like. In particular, the present invention concerned with generation of gripping forces which act via tube gripping elements, during formation of a thread package, to hold a bobbin tube or thread package forming or formed on a bobbin tube securely on the chuck.

Generally speaking, the chuck for a winding machine as contemplated by the present development comprises a first axially moveable part, a second part spaced axially from the first axially moveable part, an elastically deformable body disposed between the first and second parts to bias them in a direction increasing the spacing between the first and second parts, and with tube gripping elements moveable radially in response to axial movement of the first axially moveable part.

Chucks for winding synthetic filament threads or yarns are known, for example, from U.S. Pat. No. 4,336,912, granted June 29, 1982, U.S. Pat. No. 4,460,133, granted July 17, 1984, U.S. Pat. No. 3,030,039 and U.S. Pat. No. 4,458,850, granted July 10, 1984. These chucks are incorporated in use in a winding machine, being mounted cantilever-fashion for rotation about their own longitudinal axes, as exemplified for example by, U.S. Pat. No. 4,014,476, granted Mar. 29, 1977 and European Pat. No. 73,930, published Nov. 19, 1987. and European Published Patent Application No. 161,385, published Nov. 19, 1987.

During package building or formation, the chuck must rotate around its own longitudinal axis and simultaneously hold the bobbin tube or tube, in which the package is continuously being wound, for slip-free rotation with the chuck. For this purpose, it is known to force tube gripping elements radially outwardly against the internal surface of the bobbin tube by generating an axially directed gripping force; see for example, U.S. Pat. No. 3,052,420, U.S. Pat. No. 3,554,455, U.S. Pat. No. 4,068,806, granted Jan. 17, 1978, U.S. Pat. No. 4,142,690, granted Mar. 6, 1979, U.S. Pat. No. 4,232,835, granted Nov. 11, 1980, and British Pat. No. 2,023,256, published Dec. 28, 1979. As shown in U.S. Pat. No. 4,142,690, the gripping forces are usually generated by groups of Belleville springs.

There has been disclosed a new chuck design in which the tube-carrying part and the bearing part are made in one piece. In this connection reference is made to European Patent Application Ser. No. 86113104.3 published as European published Patent Application No. 0,217,276, published Apr. 8, 1987 and U.S. application Ser. No. 06/911,816, filed Sept. 26, 1986, to the latter of which reference may be readily had and the disclosure of which is incorporated herein by reference.

A tube gripping system has been proposed in which the gripping forces are generated by bodies of porous elastomer. Equivalent applications again have been filed in Europe under European patent application Ser. No. 86113787.5 published as European Published Patent application No. 0,219,752, published Apr. 29 1987 and U.S. application Ser. No. 919,652, filed Oct. 16, 1986, now U.S. Pat No. 4,784,343, granted Nov. 15, 1988, to the latter of which reference likewise may be readily had and the disclosure of which is incorporated herein by reference.

As described in the aforementioned U.S. application Ser. No. 06/919,652, now U.S. Pat. No. 4,784,343, the generation of gripping forces by Belleville springs is associated with several problems. Certain problems of such elements will be subsequently emphasized in the course of describing the drawings of this disclosure. The problems of Belleville springs can be solved by the use of porous elements in accordance with the aforementioned commonly assigned U.S. application Ser. No. 06/919,652, now U.S. Pat. No. 4,784,343, but the suspicion remains that in the longer term, such elastomeric materials will be subject to aging effects which will prejudice the gripping performance. If this occurs in practice, the force-generating elements must be exchanged. Furthermore, the assembly and release forces are very high.

SUMMARY OF THE INVENTION

Therefore, with the foregoing in mind it is a primary object of the present invention to provide a new and improved construction of a chuck equipped with a tube gripping system for a winder which is not afflicted with the aforementioned potential shortcomings of the heretofore noted constructions.

Another and more specific object of the present invention aims at providing a new and improved construction of a chuck equipped with a tube gripping system for a winder and having a lower risk of aging and capable of operation with lower operating forces.

Still a further significant object of the present invention is directed to a new and improved construction of a chuck equipped with a tube gripping system for a winder, wherein the tube gripping system is structured such that it firmly and positively grips and retains in place on the chuck the bobbin tubes or the like upon which there are wound the thread or yarn packages.

A further important object of the present invention is concerned with the provision of uniquely constructed tube gripping systems for chucks of a winder which afford positive retention of the bobbin tubes and thread packages formed thereon and which tube gripping systems retain this positive retention capability over long periods of service life in a highly reliable and efficient manner.

Yet another noteworthy object of the present invention is directed to a new and improved construction of a chuck equipped with a tube gripping system for a winder, wherein the tube gripping system is relatively simple in construction and design, quite economical to manufacture, highly reliable in operation, not readily subject to breakdown or malfunction, requires a minimum of maintenance and servicing, and is operative over longer periods of time with lower risk of aging.

An example of the invention will be described below in connection with a chuck in accordance with the aforementioned commonly assigned U.S. application Ser. No. 06/911,816 and with reference to the drawings. The invention is, however, not limited to use in combination with this type of chuck.

A chuck in accordance with the present invention comprises a part moveable axially with reference to the chuck, an abutment, and an elastically deformable body located between the part and the abutment. When this elastically deformable body is deformed by compression between the part and the abutment, it exerts a return force on the part, this force being axially directed with reference to the chuck. In addition, the chuck comprises tube gripping elements which move radially upon axial movement of the part, for example, the part can be formed as a cone and the tube gripping elements can be seated on the surface of this axially moveable part.

The above features of the invention are also present in the previously mentioned state of the art. However, the invention is characterized in that confining or limiting means are provided to substantially prevent radial deformation and radial shifting of the elastically deformable body. The differences over a Belleville spring system will be discussed in the description of FIGS. 1 and 2.

The above characterizing feature of the invention is also present in the embodiment incorporating porous elastomer (in accordance with U.S. application Ser. No. 06/919,652), now U.S. Pat. No. 4,784,343. The new construction differs from the preceding one in the provision of the free space surrounding the elastically deformable body; this free space takes-up axial deformation of the elastically deformable body. In the previous embodiment, the space between the part and the abutment is substantially filled by the porous elastomer.

In accordance with a further feature of the invention, axial deformation of the elastically deformable body appears as an expansion of its cross-section. This feature will be further explained in the course of the description of the Figures in comparison with Belleville springs.

In the preferred embodiment, the elastically deformable body is formed of a compact elastomeric material. In this embodiment, the elastically deformable body can be connected to two confining or limiting means to form a replaceable element or unit, one confining or limiting means preventing deformation radially inwardly and the other preventing deformation radially outwardly. Two such elements can be arranged next to each other with mutual contact via their respective confining or limiting means, so that axial forces can be transferred between the elements by way of the contacting confining or limiting means.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the structure of the tube gripping system for a chuck of a winder and the related structure have been illustrated therein as are needed to enable one skilled in the art to readily understand the underlying principles and concepts of the present invention. At this juncture it is firstly mentioned that neither the embodiment shown in FIG. 1 nor that shown in FIG. 2 is intended as a practical embodiment of the invention. These Figures enable undertaking an explanation of the basic principles of the invention and a comparison with the state of the art, especially with conventional Belleville spring arrangements.

Figure 1:
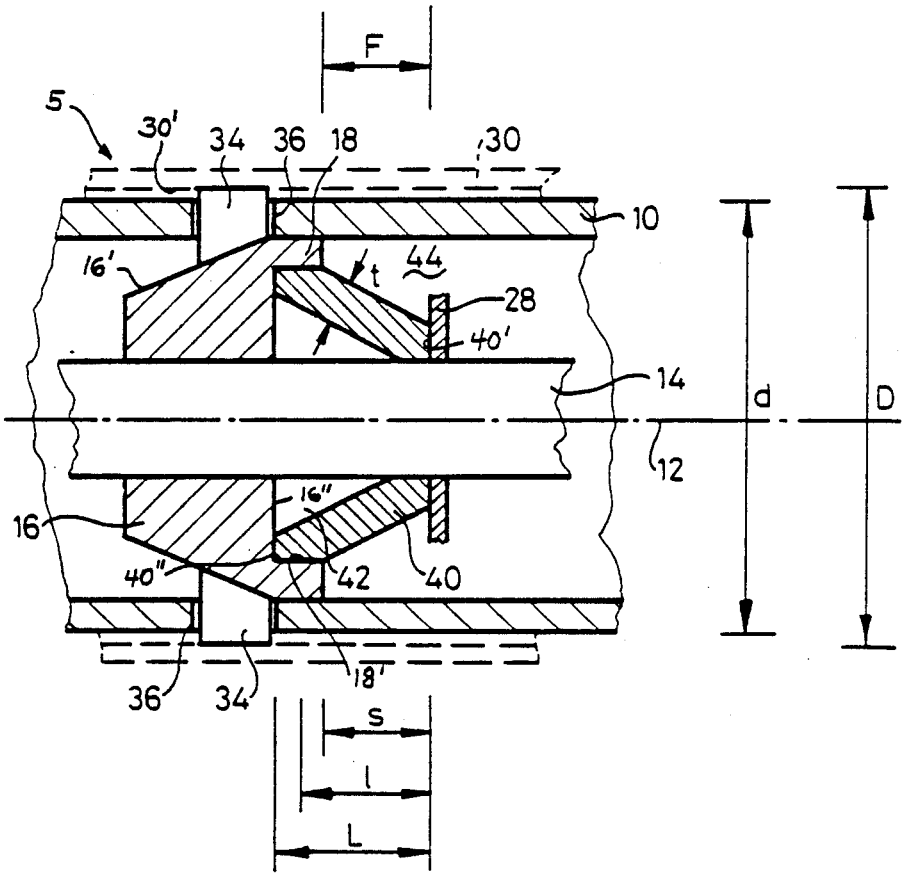
FIG. 1 shows a longitudinal section through a tube gripping system constructed in accordance with the present invention.
Figure 2:
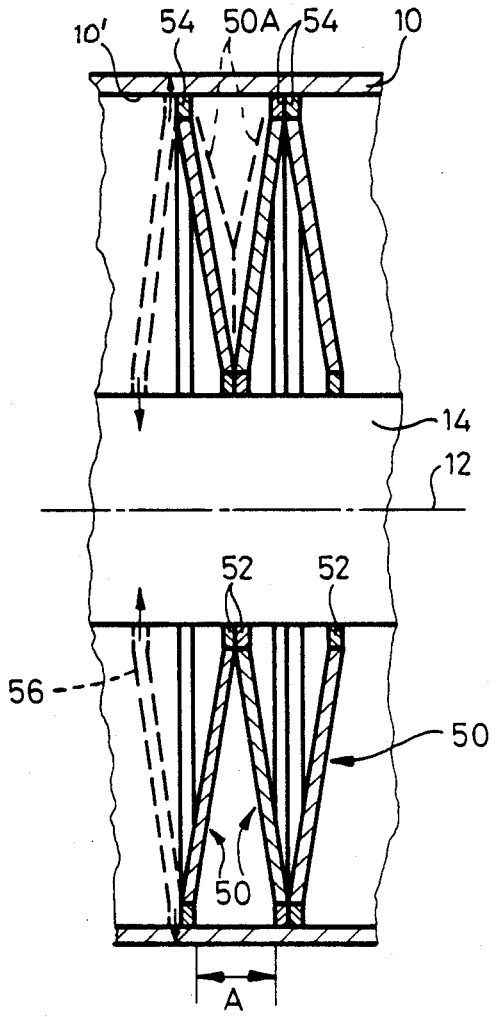
FIG. 2 shows a corresponding section through another embodiment in accordance with the present invention, more closely resembling the known Belleville spring arrangements and demonstrating the distinction between this invention and the previously known systems.

Turning now specifically to FIG. 1 of the drawings, the system illustrated therein by way of example and not limitation, will be seen to comprise an outer shell or cylinder 10 of a chuck, generally indicated by reference numeral 5, of any required type with a longitudinal axis 12 defining an axis of rotation. A central guide 14 is arranged coaxially with respect to the outer shell or cylinder 10. A substantially conical element 16 with an external flange 18 is seated on the central guide 14. Tube gripping elements 34, only two of which are illustrated in FIG. 1, ride on the conical surface 16' of the conical element 16 and project radially outwardly therefrom into respective corresponding openings or recesses 36 in the outer shell 10. The conical element 16 is moveable in the longitudinal or axial direction of the outer shell or cylinder 10, the tube gripping elements 34 sliding on the conical surface 16' of the conical element 16 while being shifted radially inwardly or outwardly through their respective openings or recesses 36.

When the substantially conical element 16 is moved to the left as viewed in FIG. 1, the tube gripping elements 34 are moved radially outwardly against the internal surface 30' of a bobbin tube 30 (indicated in dotted lines in FIG. 1) donned on the outer shell or cylinder 10. Due to the contact between the tube gripping elements 34 and the bobbin tube 30 or the like, the latter is held securely on the chuck during the to build the thread package. After completion of the thread package on the bobbin tube 30, the conical element 16 can be moved or displaced to the right as viewed in FIG. 1 so that the tube gripping elements 34 are no longer pressed against the internal surface 30' of the bobbin tube 30 and the latter is free for removal or doffing. To enable release of the bobbin tube 30, any suitable means (not shown) exerts a force on the conical element 16 to move the latter to the right against a bias. The generation of this bias is the subject of the present invention as will now be described.

An abutment or abutment member 28 is appropriately fixedly mounted with reference to the outer shell or cylinder 10 and the central guide 14. A resiliently or elastically deformable body 40, in the form of a hollow frusto-cone, contacts at its smaller end or end portion 40', the central guide 14 and the abutment 28, and at its larger end or end portion 40'', the end face 16'' of the conical element 16 and the internal surface 18' of a flange 18. In all operating conditions, the elastically deformable body 40 is compressed between the conical element 16 and the abutment 28. Since the abutment 28 is firmly fixed to the central guide 14, the elastically deformable body 40 exerts an axially directed force on the conical element 16, biasing the conical element 16 away from the abutment 28 (to the left in FIG. 1). Suitable means which may be fluid operated means such as will be explained in connection with the embodiment of FIG. 3 (but not here shown in FIG. 1), are provided to limit the movement of the conical element 16 away from the abutment 28 and hence the radially outward movement of the tube gripping elements 34. This condition determines the maximum internal diameter of the bobbin tubes 30 to be retained on the chuck 5 by this tube gripping system. Tubes of lower internal diameter, down to the external diameter of the outer shell or cylinder 10, can be held with a smaller spacing between the conical element 16 and the abutment 28.

Assuming, for example, that the bobbin tube 30 has the maximum designed external diameter D, this corresponds to a predetermined spacing between the conical element 16 and the abutment 28. If, however, the internal diameter of the bobbin tube corresponds to the external diameter d of the outer shell or cylinder 10, the spacing between the conical element 16 and the abutment 28 is reduced to 1. The range of spacings L to l can be designated the "tube gripping range" and the force/-distance characteristic of the elastically deformable body 40 must be so selected that predetermine tube gripping forces are exerted by the tube gripping elements 34 on the bobbin tube 30 to be gripped throughout the tube gripping range.

In order to ensure release of the bobbin tube 30, the spacing between the conical element 16 and the abutment 28 must be reduced still further, for example to s. In this condition, the elastically deformable body 40 must exert a predetermined maximum bias on the conical element 16, which must be overcome by the release means during the release operation.

The elastically deformable body 40 is made of compact elastomeric material, that is, without significant porosity. To permit deformation of the elastically deformable body 40 during reduction of the spacing from L to s, a space must be left free around the elastically deformable body 40. For this purpose, a chamber 42 is left free within the elastically deformable body 40 and another chamber 44 is left free around the elastically deformable body 40. However, deformations of the end portions 40' and 40'' of the elastically deformable body 40 are limited met simply by contact with the abutment 28 and the end face 16'' of the conical element 16, but also by contact with the central guide 14 and the internal surface 18' of the flange 18. The axial forces transmitted from the conical element 16 load the elastically deformable body 40 in compression and/or shear. The result is an expansion or enlargement of the wall thickness t, although the expansion is not necessarily uniformly distributed over the whole length of the elastically deformable body 40.

FIG. 2 shows a variant with modified Belleville springs to highlight the difference between this invention and a conventional packet of Belleville springs. The central guide 14 and the outer shell or cylinder 10 are the same as those shown in FIG. 1 and it can be assumed that the complete assembly comprises an abutment fixed to the central guide 14 (similar to the abutment 28 in FIG. 1) and a substantially conical element 16 (similar to the substantially conical element 16 in FIG. 1, but without the flange 18); these elements are, however, not illustrated in FIG. 2 to simplify the drawing representation.

In FIG. 2, the bias on the conical element 16 is effected by a packet of Belleville springs 50, only three of which are shown in this FIG. 2. Each of these Belleville seated on the central guide 14, and an external ring 54 which has a close fit on the internal surface 10' of the outer shell or cylinder 10. Axial forces are transferred between neighboring Belleville springs 50 by contact of their external rings 54 and/or their internal rings 52.

In order to compress the packet of Belleville springs 50, the spacing A between two neighboring, but non-contacting, external rings 54 must be reduced. The dimensions of the internal and external rings 52 and 54 do not change. The elastic discs or springs 50 between these rings 52 and 54 must therefore "bulge" as indicated in dotted lines 50A.

The spring 56 indicated in dash-dot lines is a conventional Belleville spring without internal and external rings 52 and 54. The axial loading, which generates the bulge 50A, would not have the same effect on the Belleville springs 56. Instead, under this loading, the internal diameter of the Belleville spring 56 would be reduced and/or the external diameter enlarged as indicated by the small arrows.

In a conventional spring packet containing Belleville springs 56, the axial forces must be cleanly transferred from one spring to its neighbor. None of these springs 56 can therefore be allowed to expand so far inwardly or outwardly that it jams on the central guide 14 or the outer shell or cylinder 10. In other words, at the inner and outer edges of each disc or spring 56, there must be adequate play to enable the expansion which is essential for operation. The packet as a whole cannot therefore be arranged for secure guidance in the complete assembly and the individual springs 56. can shift radially under the influence of centrifugal force; this can lead to significant unbalance in the complete assembly.

Furthermore, up to 30 Belleville springs 56 must be arranged next to each other in a packet to generate the tube 1 gripping forces of up to 300 Newton currently required. The loading must be fairly evenly distributed between the individual springs 56 to prevent so-called "reversal" of a spring. Then, instead of being disposed mirror-image fashion, the reversed spring lies parallel to its two neighbors. The packet then no longer exhibits the required spring characteristic.

The provision of the internal and external confining or limiting rings 52 and 54 can prevent the undesired expansion of the new disc springs and the whole packet can be firmly guided at its radially inner and outer edges. In addition, the risk of the aforementioned spring reversal due to the deformation 50A is eliminated. However, there is still the problem that a relatively large number of individual springs must be assembled to make up the packet in order to generate the required gripping forces. The preferred embodiment, which will now be described in connection with FIG. 3, is based on the variant of FIG. 1, enabling generation of the necessary gripping forces with a relatively small number of individual springs.

Figure 3:
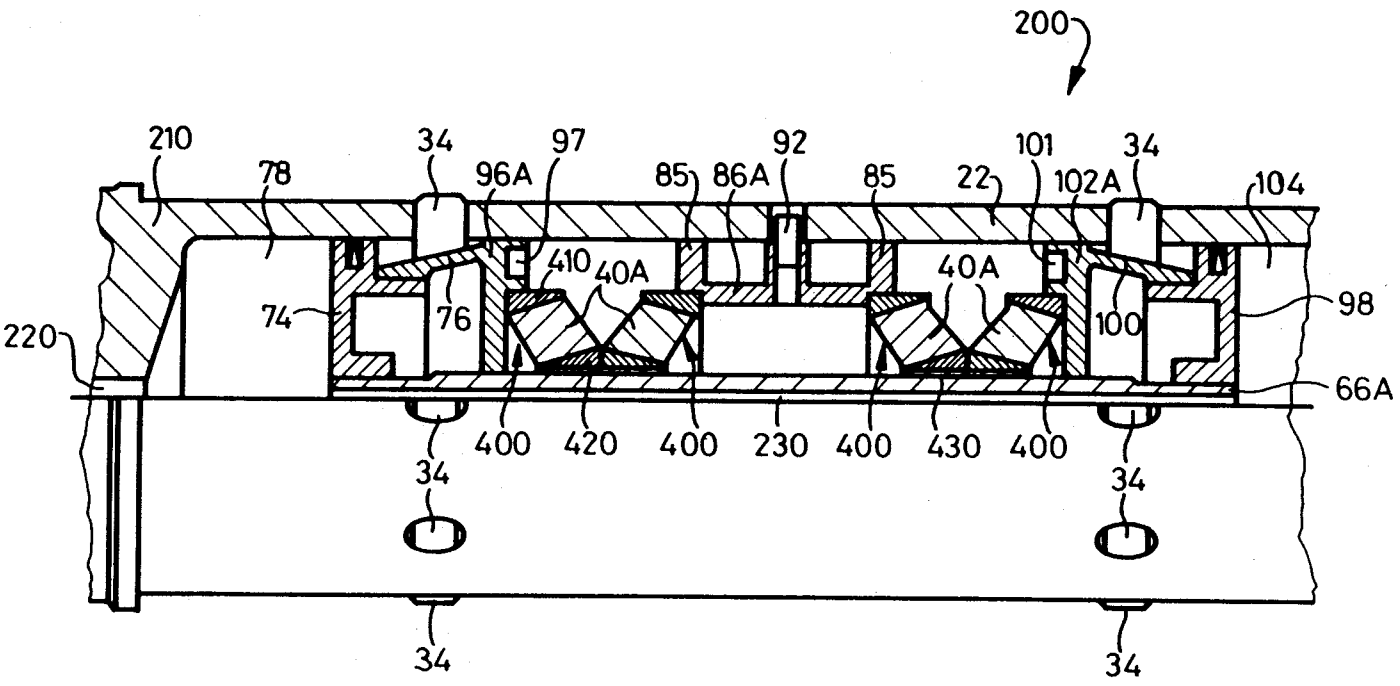
FIG. 3 shows a side view, in partial section, of a preferred embodiment of the invention.

The general structure of the chuck 200 partially illustrated in FIG. 3, corresponds substantially to the structure of the chucks shown in previously mentioned U.S. applications Ser. No. 06/919,652, now U.S. Pat. No. 4,784,343 and 06/911,816 and the reference numerals used in FIG. 3 correspond as far as possible with the reference numerals used in the previously mentioned applications.

The outer shell or cylinder defining the tube-carrying portion of the chuck 200 is indicated with the reference numeral 22. This outer shell or cylinder 22 is connected by suitable means 210 (only partially illustrated) with a suitable bearing portion which has not been particularly illustrated but would be located to the left of the depicted parts. The chuck 200 is so designed that by rotation about its own longitudinal or rotational axis, it can wind a plurality of threads or the like simultaneously to form individual thread packages or the like. For each thread or the like to be wound, the chuck 200 must receive a corresponding empty bobbin tube (not shown in FIG. 3 but, for instance, like the bobbin tube 30 of FIG. 1) and must retain it securely during building of the thread package. FIG. 3 shows the tube gripping assembly for such a bobbin tube, namely for the one carried in use at the so-called "inner" or inbound end of the outer shell or cylinder 22 which is located next to the bearing portion. In the non-illustrated extension of the outer shell or cylinder 22 located to the right of FIG. 3, a similar tube gripping assembly is provided for each thread to be wound, in other words, each additional bobbin tube.

The assembly shown in FIG. 3 comprises an abutment or abutment member 86A which is secured by appropriate fixation means, such as screws or bolts 92 or the like relative to the outer shell or cylinder 22. The assembly also comprises two tube gripping devices arranged in mirror-image fashion on opposite sides of the abutment 86A, but otherwise similarly constructed. The following description refers primarily to the left-hand tube gripping device, the reference numerals for the corresponding parts of the right-hand tube gripping device being appended below in each case in parenthesis.

The tube gripping device includes a set of tube gripping elements 34 (34) moveable radially outwardly as shown in and described previously with reference to FIG. 1 by axial movements of a cone or conical element 76 (100). The cone 76 (100) is connected at its larger end with a guide portion 96A (102A) which slides on the internal surface of the outer shell or cylinder 22 in order to guide the axial movements of the cone 76 (100). At its smaller end, the cone 76 (100) adjoins an annular piston or piston member 74 (98) which is guided at its outer edge on the internal surface of the outer shell or cylinder 22 and at its inner edge on a connecting tube 66A. On the other side of the piston 74 (98), the hollow space inside the outer shell or cylinder 22 is left free to form a pressure chamber 78 (104). The various pressure chambers 78 (104) can be supplied with a suitable pressure or pressurized medium through the bearing portion via a suitable lead or conduit 220 and via the connecting duct 230 provided in the guide tube 66A. If the pressure chamber 78 (104) is pressurized, the piston 74 (98) moves along the guide tube 66A towards the abutment 86A.

The cone or conical element 76 (100) follows the movement of the piston 74 (98) thus releasing a bobbin tube or package. However, this movement can only be carried out by (102A) by two spring elements 400 (400). As indicated by the overcoming the bias applied to the guide part or portion 96A. reference numerals, the spring elements 400 are identical in construction and only one will be individually described in detail by way of example in the following.

Each spring element 400 comprises a substantially frusto-conical body 40A of compact elastomeric material, similar to the elastically deformable body 40 in FIG. 1 and also an outer metal ring 410 and an inner metal ring 420. The frusto-conical body or elastically deformable body 40A is fixedly secured over its complete wall thickness at its larger end with the internal surface of the ring or ring member 410 and at its smaller end, with the external surface of the ring or ring member 420. Each spring element 400, including the frusto-conical body 40A and the rings 410 and 420, is therefore mounted in the assembly as a unit, the individual spring elements 400 being arranged in pairs, mirror-image fashion relative to each other so that one ring 410 of the pair engages the abutment 86A and the other ring 410 of the pair engages the respective guide portion 96A (102A). The axial forces are transferred between the elements 400 of the pair by contact of their inner rings 420.

The internal surface of each ring 420 is provided with a low-friction coating 430 which fits closely on the outer surface of the guide tube 66A so that the relocked element 400 can slide freely along the guide tube 66A. The external surface of one ring 410 of a spring pair is positioned by a flange 85 on the abutment 86A and the outer surface of the other ring 410 of the spring pair is positioned by a flange 97 (101) on the guide part or portion 96A (102A). The inner and outer ring 420 and 410 form confining or limiting means which limit the freedom of movement of the frusto-conical body or elastically deformable body 40A outwardly and inwardly under deformation.

FIG. 3 shows the tube gripping assembly in its relatively relaxed condition, that is, with the tube gripping elements 34 moved radially outwardly as far as possible. Suitable means (not shown, for example, on the individual tube gripping elements 34) can be provided to define this "relaxed" condition. As described in connection with the embodiment of FIG. 1, each frusto-conical body 40A is already compressed by the rings 410 and 420 in this condition so that the desired axial force is exerted on the respective guide part or portion 96A (102A) and thereby the tube gripping elements 34 are subjected to the required gripping forces. When the pressure chambers 78 (104) are pressurized, the frusto-conical bodies 40A are still further compressed between their respective rings 410 and 420, the gripping forces being cancelled. The axial forces, which are transferred from the abutment 86A and the guide parts or portions 96A (102A) to the spring elements 400, load each frusto-conical body 40A in compression and shear, so that the wall thickness of the element expands relative to its fully relaxed condition (not shown).

Suitable spring elements are commercially available from the Huber & Suhner company of Pfäffikon, Switzerland, under the general name "Vibratex-elements". The embodiment shown in FIG. 3 is a special form of the Vibratex V14 element, the internal surface of the outer ring 410 and the external surface of the inner ring 420 being arranged with a slight inclination to the chuck or longitudinal axis to enable better transfer of axial forces to the frusto-conical body 40A. In the normal form of this Vibratex V14 element, the internal and external surfaces of both rings 410 and 420 are coaxial.

In the embodiment shown in FIG. 3, each individual spring element 400 is in the form of a body of rotation. This is not an absolute necessity. The rotational symmetry of the complete assembly is important and this is assisted by rotational symmetry of the individual components. Additionally, each spring element 400 is firmly guided and centered relative to the chuck axis radially inwardly by the cylinder 66A and radially outwardly by the flange 85 or 97 (101). Accordingly, unbalance cannot arise from radial movement of the assembly as a whole.

Unbalance is, however, possible due to unsymmetrical deformation of the elastic or elastically deformable or frusto-conical body. Insofar as the elastic or elastically deformable body is still free to expand radially, the deformation must be symmetrically distributed around the chuck axis. In this connection, the effects of the axial forces and also those of the centrifugal force must be taken into account. In an embodiment in accordance with FIG. 1, it could therefore prove necessary to use a flange on the abutment 28 to prevent or limit radial expansion of the smaller end of the elastic or elastically deformable body 40. In the variant according to FIG. 3, the radial expansion of the smaller end of the frusto-conical or elastically deformable body 40A, is limited by vulcanization on the ring 420. In addition, the "free length" F (FIG. 1) of the elastic or elastically deformable body is kept short in order to hold the free radial expansion low.

In the preferred variants, the deformation required for generation of the return force is created as far as possible by shear loading. The freedom of the elastic or elastically deformable body to expand radially can then be reduced to a minimum. For use in a chuck, the Shore A hardness can be selected in the range 30 to 90, values in the Shore A hardness range of 50 to 80 being preferred. The characteristic property in shear loading is the shear modulus. The elastic body can exhibit a shear modulus in the range 30 to 280 $N/cm^2$, a value in the shear modulus range of 50 to 200 $N/cm^2$ being preferred.

When a plurality of frusto-conical elements are used, it is not necessary to arrange them with their smaller ends in contact as shown in the embodiment of FIG. 3, rather the transfer of axial forces can also be effected by contact of the larger ends.

In the assembly, each element must be centered with reference to the axis of rotation. For this purpose, it is not necessary to provide an inner and an outer guide. If a central element extending through the whole assembly (guide tube 66A) is not required, each spring element can be filled in internally or can be pimply limited inwardly by its own internal ring.

While there are shown and described present preferred embodiments of the invention, it is to be distinctly understood that the invention is not limited thereto, but may be otherwise variously embodied and practiced within the scope of the following claims. Accordingly,

What we claim is:

1. A chuck for a winding machine, comprising:

a first axially moveable part;

a second part spaced axially from the first axially moveable part;

an elastically deformable body arranged between the first and second parts to bias said first and second parts in a direction increasing the spacing between said first and second parts;

said elastically deformable body having end portions;

tube gripping elements moveable radially in response to axial movement of the first axially moveable part; and means in contact with said elastically deformable body to prevent radial movements of at least said end portions of the elastically deformable body.

2. The chuck for a winding machine as defined in claim 1, further including:

means defining a free space which is located around said elastically deformable body to take-up axial deformations thereof.

3. The chuck for a winding machine as defined in claim 2, wherein:

said elastically deformable body is expansible in its cross-section in order to generate said axial deformations of said elastically deformable body.

4. The chuck for a winding machine as defined in claim 1, wherein:

said elastically deformable body comprises a compact elastomeric material.

5. The chuck for a winding machine as defined in claim 1, wherein:

said elastically deformable body defines a substantially frusto-conical elastically deformable body.

6. The chuck for a winding machine as defined in claim 1, wherein:

said contact means compose at least one means limiting radial movement of said elastically deformable body and fixedly connected to said elastically deformable body.

7. The chuck for a winding machine as defined in claim 6, further including:

a plurality of said elastically deformable bodies arranged next to each other in axial direction and contacting each other via said at least one means for limiting radial movement to transfer axial forces between said plurality of said elastically deformable bodies.

8. The chuck for a winding machine as defined in claim 6, wherein:

said at least one means comprises an inner limiting means and an outer limiting means; and said elastically deformable body being connected with said inner limiting means and said outer limiting means.

9. The chuck for a winding machine as defined in claim 8, further including:

a plurality of said elastically deformable bodies arranged next to each other in axial direction and contacting each other via said at least one means for limiting radial movement in order to transfer axial forces between said plurality of said elastically deformable bodies.

10. The chuck for a winding machine as defined in claim 1, wherein:

said tube gripping elements define sets of tube gripping elements; and a pair of said elastically deformable elements being provided for each set of said tube gripping elements.

11. The chuck for a winding machine as defined in claim 1, further including:

an element connected with said elastically deformable body; and said elastically deformable body and said element connected therewith being substantially rotationally symmetrical.

12. The chuck for a winding machine as defined in claim 1, wherein:

said elastically deformable body has a shear modulus of 30 to 280 $N/cm^2$.

13. The chuck for a winding machine as defined in claim 12, wherein:

said shear modulus of said elastically deformable body lies in the range of 50 to 200 $N/cm^2$.

14. A chuck for a winding machine, comprising:

an axially moveable first part;

a second part axially spaced from the axially moveable first part;

an elastically deformable body located between the first and second parts to bias said first and second parts in a direction of increasing spacing between said first and second parts;

tube gripping elements moveable radially in response to axial movement of said axially moveable first part; and means for subjecting said elastically deformable body, during use of the chuck, to loading in shear to generate said bias.

15. The chuck for a winding machine as defined in claim 14, wherein:

said elastically deformable body has a shear modulus of 30 to 280 $N/cm^2$.

16. The chuck for a winding machine as defined in claim 15, wherein:

said shear modulus of said elastically deformable body lies in the range of 50 to 200 $N/cm^2$.

* * * * *

UNITED STATES PATENT AND TRADEMARK OFFICE

CERTIFICATE OF CORRECTION

PATENT NO. : 4,830,299

DATED : May 16, 1989

INVENTOR(S) : HEINZ MUTTER et al

It is certified that error appears in the above-identified patent and that said Letters Patent is hereby corrected as shown below:

Column 1, line 31, after "No." please insert --United States Patent No. 4,298,171, granted November 3, 1981,--

Column 1, line 33, after "73,930" please delete "November 19,"

Column 1, line 34, at the beginning of the line, please delete "1987" and insert --, published December 3, 1986--

Column 4, line 38, after "the" (second occurrence), please insert --rotation about the longitudinal or rotational axis 12 required--

Column 5, line 65, after "Belleville", please insert --springs 50 comprises an internal ring 52 which is closely--

Column 6, line 33, after "tube", please delete "1" (one)

Column 7, line 54, after "by", please insert --overcoming the bias applied to the guide or portion 96A--

UNITED STATES PATENT AND TRADEMARK OFFICE

CERTIFICATE OF CORRECTION

PATENT NO. : 4,830,299

DATED : May 16, 1989

INVENTOR(S) : HEINZ MUTTER et al

It is certified that error appears in the above-identified patent and that said Letters Patent is hereby corrected as shown below:

Column 7, line 55, please delete "overcoming the bias applied to the"

Column 7, line 56, please delete "guide part or portion 96A."

Column 9, line 40, after "be" (second occurrence) please delete "pimply" and insert --simply--

Column 10, line 16, after "means" please delete "compose" and insert --comprise--

Column 10, line 30, after "comprises" please delete "an inner" and insert --a first--

Column 10, line 31, please delete "an outer" and insert --a second--

UNITED STATES PATENT AND TRADEMARK OFFICE

CERTIFICATE OF CORRECTION

PATENT NO. : 4,830,299

DATED : May 16, 1989

INVENTOR(S) : HEINZ MUTTER et al

It is certified that error appears in the above-identified patent and that said Letters Patent is hereby corrected as shown below:

Column 10, line 33, after "said" (first occurrence) please delete "inner" and insert --first-- and after "said" (second occurrence) please delete "outer" and insert --second--.

Signed and Sealed this

Fourteenth Day of November, 1989

*Attest:*

JEFFREY M. SAMUELS

*Attesting Officer*

*Acting Commissioner of Patents and Trademarks*